US005848656A

United States Patent [19]

Møksvold

[11] Patent Number: 5,848,656

[45] Date of Patent: Dec. 15, 1998

[54] DEVICE FOR CONTROLLING UNDERWATER PRESSURE

[76] Inventor: Harald Møksvold, Vollaugmoen, N-2032, Maura, Norway

[21] Appl. No.: 638,634

[22] Filed: Apr. 26, 1996

[30] Foreign Application Priority Data

Apr. 27, 1995 [NO] Norway ..... 951624

[51] Int. Cl.[6] ..... E21B 7/128

[52] U.S. Cl. ..... 175/7

[58] Field of Search ..... 175/7; 166/359, 166/358, 363, 364, 365

[56] References Cited

U.S. PATENT DOCUMENTS

| | | | |
|---|---|---|---|
| 3,179,179 | 4/1965 | Kofahl | 166/363 |
| 3,825,065 | 7/1974 | Lloyd et al. | 175/7 |
| 4,046,191 | 9/1977 | Neath . | |
| 4,193,455 | 3/1980 | Steddum et al. | 166/359 |
| 4,291,772 | 9/1981 | Beynet | 175/7 X |
| 5,184,686 | 2/1993 | Gonzales | 175/5 |
| 5,199,683 | 4/1993 | Le . | |
| 5,533,574 | 7/1996 | Gonzalez | 175/7 X |

*Primary Examiner*—Hoang C. Dang
*Attorney, Agent, or Firm*—Hedman, Gibson & Costigan, P.C.

[57] ABSTRACT

The present invention relates to a device for controlling underwater pressure, which device is adapted for use in drilling installation comprising subsea blow-out preventer (1) and surface blow-out preventer (2) wherebetween a riser (3) is arranged for communication, and for the purpose of defining a device in which the use of choke line and kill line can be avoided, it is according to the invention suggested that the device comprises a high pressure riser (3) and a high pressure drilling pipe (14) which are so arranged between the subsea blow-out preventer (1) and the surface blow-out preventer (2) that they can be used two separate high pressure lines as a substitute for choke line and kill line.

7 Claims, 2 Drawing Sheets

TO ACTIVE MUD SYSTEM
CHOKE MANIFOLD
18
ISV
OSV
XOV
2
OFV
IFV
SOC
SIC
USA
USSSR
USGSR
LSGSR
LOWER QUICK LATCH LQL
14
17
SIK
SOK
SURFACE BOP.
MAIN MUD PUMPS 5K MWP

DEVICE FOR CONTROLLING UNDERWATER PRESSURE

FIELD OF THE INVENTION

The present invention relates to a device for controlling underwater pressure, which device is adapted for use in drilling installation comprising subsea blow-out preventer and surface blow-out preventer wherebetween a riser is arranged to communicate.

PRIOR ART

From U.S. Pat. No. 4,046,191 (Neath) there is known a method and an apparatus used for off-shore drilling operation, wherein are implemented a subsea hydraulic choker. A floating vessel or a drilling platform is arranged at the water surface, and a riser assembly extends between the platform and the well, the blow-out preventers being arranged therebetween close to the lower end of the riser pipe assembly. According to this prior art, at least one by-pass connection will provide at least one fluid flow path for the high pressure fluid which can flow from the well at a point below at least one of the blow-out preventers, to the lower interior portion of the riser conduit at a point above the uppermost blow-out preventer. A means in each of the fluid by-pass conduits controls the fluid flow through the conduit for regulating the fluid pressure in the well when the blow-out preventers are in a closed position.

When said subsea hydraulic choker is in operation, the riser pipe assembly can be used as described in said US patent publication. In addition there will, according to the prior art, be used an ordinary low pressure riser which is not able to handle formation fluid under high pressure.

From U.S. Pat. No. 5,199,683 (Le) there is known a blow-out preventer which permits that the pressure above and below the corresponding pipe rams will be equalized before the pipe rams are opened. This ram type blow-out preventer comprises a simple by-pass connection between ram block and ram shaft. Upon closing the ram shaft will seal off the by-pass conduit in the ram block. Upon opening the conduit in the ram block will be opened, and the pressure below and above the ram block will be equalized. Consequently, the prior art will in an opening phase of the blow-out pipe ram equalize the pressure, but will not be relevant in connection with the circulation of formation fluid.

SUMMARY OF THE INVENTION

An object of the present invention is to suggest a device for controlling underwater pressure, especially pressure control of a well through a subsea blow-out preventer which is connected to the well head, and a surface blow-out preventer which is connected to a high pressure riser pipe.

Further, an object of the present invention is to provide a device for controlling underwater pressure, especially in connection with the circulation of formation fluid.

A further object of the present invention is to provide a device for controlling underwater pressure, wherein the well fluid is by-passed the blow-out preventer stack for being introduced into the riser pipe above the latter, such that choke valves on the surface vessel will reduce the pressure.

A further object of the present invention is to provide the subsea blow-out preventer in such a specific manner, that the high pressure lines, i.e. the choke line and the kill line which usually are provided between the surface system and subsea blow-out preventer for controlling an unstable well, can be eliminated.

These objects are achieved in a device of the type as mentioned in the preamble, which according to the present invention is characterized in that it comprises a high pressure riser and a high pressure drilling pipe which are so arranged between the subsea blow-out preventer and the surface blow-out preventer that they can be used as two separate high pressure lines as a substitute for choke line and kill line.

Further features and advantages of the present invention will appear from the following description of an embodiment of the invention, taken in connection with the enclosed drawing, as well as from the appended patent claims.

DESCRIPTION OF EMBODIMENT

Figures 1, 1A, 1B:
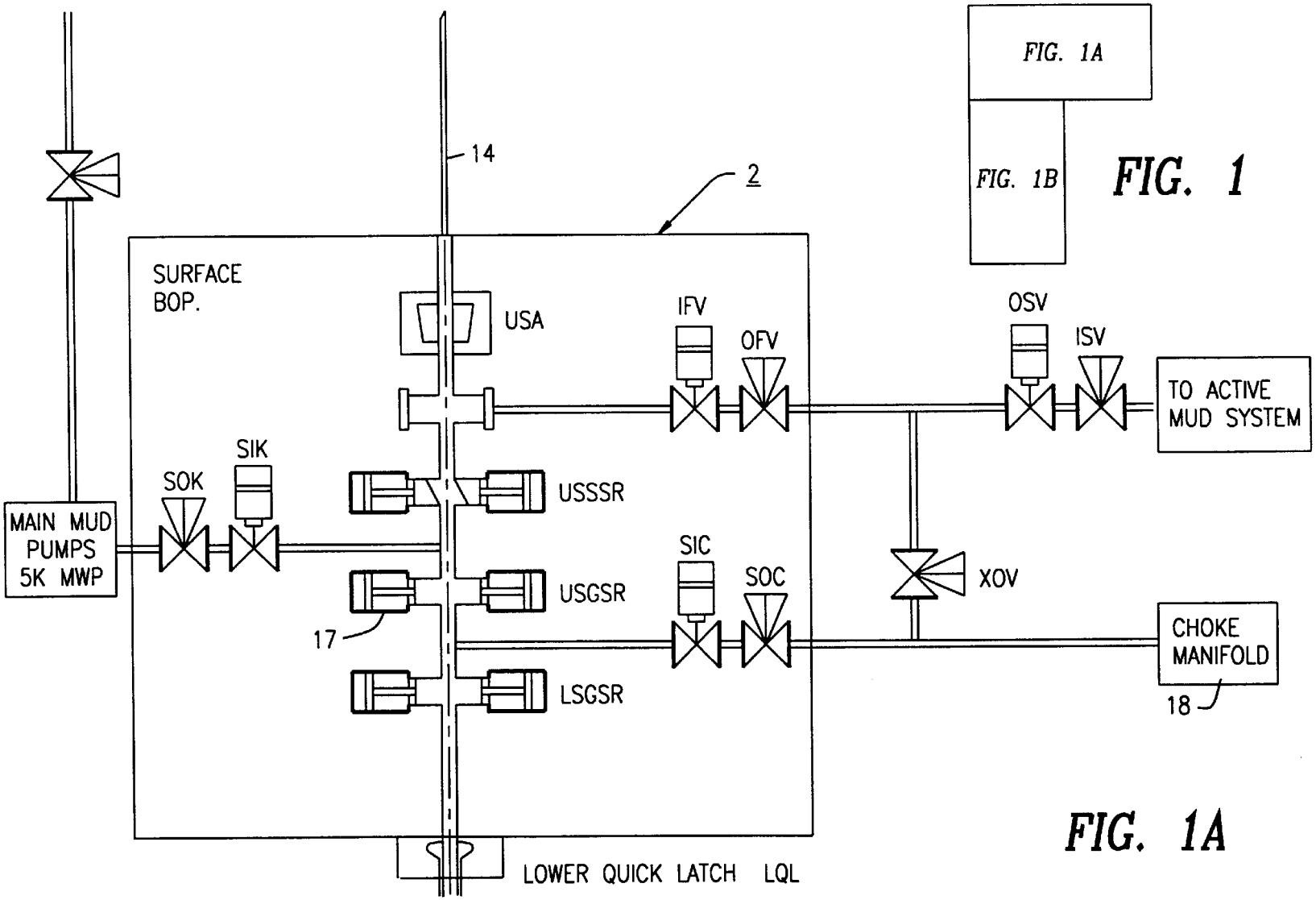
FIGS. 1, 1A and 1B illustrate an embodiment of a device according to the present invention, specifically how a subsea blow-out preventer can be arranged in order to avoid the use of choke line and kill line.
Figure 1B:
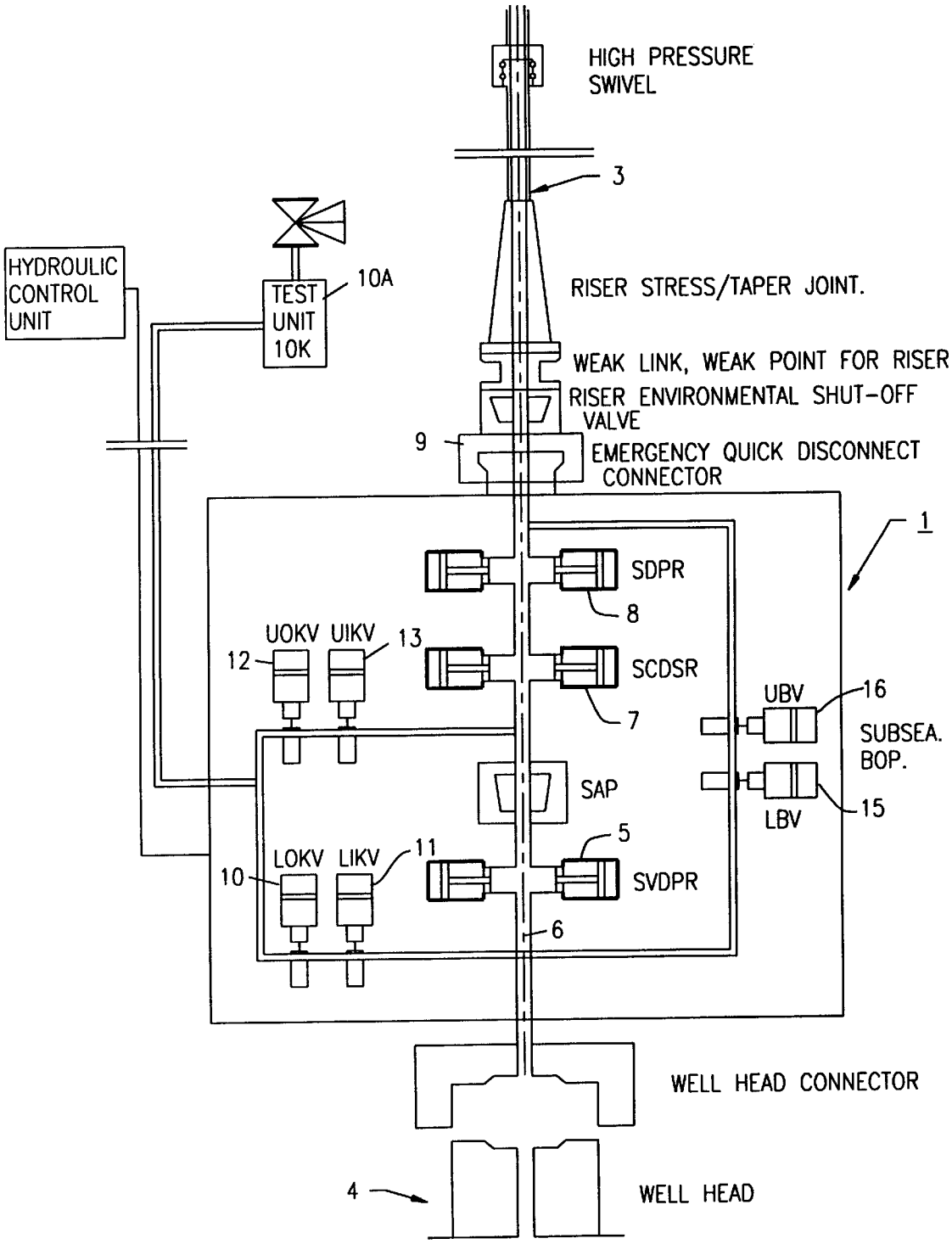

In FIGS. 1A and 1B there is illustrated an embodiment of a device according to the present invention, for controlling underwater pressure, and then specifically how a subsea blow-out preventer can be arranged in order to avoid choke line and kill line.

In order to achieve this, it is according to the invention suggested the use of drill string or drilling pipe in combination with high pressure riser pipe, all of which is adapted for being used as choke line and kill line.

It is previously known to use a subsea blow-out preventer stack, BOP stack, and from this stack a connection pipe will extend to the surface vessel, which connection pipe is usually designated riser pipe or "riser". Such a riser pipe is usually a low pressure pipe which is dimensioned for 500 psi or 35 bar. The pipe can have a diameter which is dependent upon the drilling related to the BOP stack. Normally, the drilling on a subsea BOP stack is 18¾' with a nominal riser pipe diameter of 21'. On each riser pipe length there are mounted two high pressure pipes of the same pressure class as the BOP stack. These high pressure pipes are designated as choke pipe and kill pipe. The diameter of such pipes or lines are between 2"–4". The lines are such arranged that they cannot be interchanged, said lines also being connected to outlets on the BOP stack and ending up in the choke manifold on the surface vessel.

If the well becomes unstable and the pressure in the well is increased, the BOP stack has to be shut down and the communication between the well and the surface will take place through the choke line or the kill line. In order to restabilize the well drilling mud having a proper specific weight must be circulated down into the hole through the drilling string and back through the well to the BOP stack which is closed. The return will therefore be directed through the choke line or the kill line back to the vessel or rig, because these lines can conduct gas and liquid under high pressure.

Consequently, under normal conditions the control of the well by using BOP, will be effected with the surface BOP, this involving a known method which is used on on-shore rigs and platforms.

Contrary to this the present invention suggests the use of a subsea BOP in combination with high pressure riser pipe and subsea BOP.

In other words, according to the present invention there is introduced a high pressure riser pipe which has no choke line or kill line mounted thereon, the riser pipe being adapted to take high pressure, i.e. having a pressure classification which is the same as that of the BOP stack. The riser pipe connects the subsea BOP stack and the surface BOP stack, as this is further illustrated on the enclosed FIG. 1.

In FIGS. 1A and 1B there is illustrated a subsea BOP 1 which according to the invention is arranged as a disconnect BOP stack, as well as a surface BOP stack 2 which according to the invention is to be used for well service, for example in connection with an unstable well.

If such a situation occurs, that it is necessary to release the riser pipe 3, which here is provided as a high pressure riser pipe and connects said subsea BOP 1 and said surface BOP 2, then the riser pipe 3 will be disconnected from the subsea BOP stack 1, at the same time as the well 4 is closed and secured.

What primarily then takes place is that a pipe ram 5, or more specifically a subsea variable bore drill pipe ram (SVDPR) in the subsea BOP stack 1 will be closed, said pipe ram 5 being so designed that it will allow for hang-off of the drill string 14, and at the same time provide a sealing between the subsea BOP 1 and drilling pipe 6. Thereafter, a shear ram 7, or more specifically an isolation/drill pipe/shear/sealing ram (SCDSR) is closed, which shears off the drilling string 14, and by closed shear ram 7 also the well 4 will be isolated or closed and at the same time secured. Thereafter, an emergency quick disconnect connector 9 (EQDC) is opened, for thereby releasing the riser pipe 3 just above the subsea BOB stack 1.

The situation is now that the subsea BOP stack 1 is left behind as the drill string 14 has been cut and depends from the surface BOP stack 2, at the same time as the pressure below the subsea BOP stack 1 is the same as the pressure in the well 4. For thereafter to regain communication with the well 4 it is necessary to circulate out this pressure, and in the present case such a circulation must be created by means of and between the cut drilling string 14 and the isolated well 4.

According to prior art technology one would then have used a choke line and a kill line for this reestablishment procedure.

However, according to the present invention the riser pipe 3 will be connected to the subsea BOP stack 1 and the survey of the pressure will be conducted by opening side valves 15, 16 on the subsea BOP stack 1. Said side valves 15, 16 will then by means of a testing unit 10A and associated conduit branch valves 10, 11 and 12, 13 enable communication with the riser pipe 3 which in turn will supervise and control the pressure in the well 4.

If it is necessary to circulate the well in order to achieve stability, this can be done by lowering the drill string 14 down to the subsea BOP stack 1, and when drill string 14 has entered said subsea BOP stack 1, then a second pipe ram 8 (SDPR), will be closed, the latter being arranged above the previously discussed shear ram 7 (SCDSR). The drill string 14 will then constitute a sealed connection between said pipe ram 8 (SDPR) and the surface.

Thereafter the previously mentioned shear ram 7 (SCDSR) will be opened, and communication with the inner diameter of the cut drilling pipe 6 hanging in the pipe ram 5 (SVDPR) is achieved. The pressure which is in the well 4 on the exterior side of the drilling pipe 6 will in such a case effect a pressure below the pipe ram 5 (SVDPR) which is located below said shear ram 7 (SCDSR).

By means of the side valves 10–13 on the BOP stack 1, it is then possible to establish communication, such that the pressure below the pipe ram 5 (SVDPR) can be conducted to the riser pipe 3 above the upper pipe ram 8 (SDPR) holding the recently established drill string 14.

Circulation of the well can thereafter be started in order to reestablish stability by using correct specific weight of the drilling mud. Drilling mud will be pumped down through the drilling string 14 to the upper pipe ram 8 (SDPR), through the shear ram 7 (SCDSR) and internally down the drilling string 14 hanging in the lower pipe ram 5 (SVDPR). The return will rise in the well 4 at the exterior side of the drilling string 14 towards the lower pipe ram 5 (SVDPR) which is closed, will be directed through the side valves 15 (LBV) and 16 (UBV), further into the riser pipe 3 above the upper pipe ram 8 (SDPR), up through the riser pipe 3 and towards the surface BOP stack 2 which is closed by means of a pipe ram 17 (USGSR) and further to a choke manifold 18.

In other words, according to the present invention there has been established two separate lines for circulation possibilities, and then without the use of choke line or kill line, namely by arranging the subsea BOP stack 1 in a specific manner, especially with an extra blow-out preventer for thereby enabling the receipt of the drilling string for this purpose. In addition the pipe and valve arrangement for said BOP is so designed that said objective is achieved.

In other words, there has been given an instruction for how the riser pipe is reestablished and tested in a normal manner, whereafter the drilling string is passed into the high pressure riser pipe which prior to this is at normal pressure. When the drilling string has reached the subsea BOP stack 1 the pipe ram 8 (SDPR) located above the shear ram 7 (SDRSR), is closed, and the pressure between the pipe ram 8 and the shear ram 7 is thereafter increased by "pressuring up" the drill string 14 until the same pressure is achieved as below said shear ram 7. Thereafter the shear ram 7 can be opened, and thereby is achieved communication between the drill string 14 hanging in the BOP 1 and the drill string 14 which also extends to the surface. In order to achieve communication between the well 4 and the surface, i.e. in the ring-shaped space ("annulus") the pipe system of the subsea BOP stack 1 is used such that communication is achieved between the annulus of the riser pipe 3 and the annulus of the well 4. The well can now be circulated for stability as usual, and then through the two lines which have been established as described.

The riser pipe system will with this layout be simplified to only one line or pipe which more easily and more rapidly can be handled from the surface vessel. In a situation wherein the well is unstable, the surface BOP stack 2 will be used for circulating the well to stability in the same manner as any other well having a surface BOP stack.

I claim:

1. A device for controlling underwater pressure, which device is adapted for use in a drilling well installation comprising a subsea blow-out preventer (1) and a surface blow-out preventer (2) wherebetween a riser (3) is arranged for communication, characterized in that the device comprises a high pressure riser (3) and a high pressure drilling pipe (14) which are so arranged between the subsea blow-out preventer (1) and the surface blow-out preventer (2) that they can be used as two separate high pressure lines as a substitute for choke line and kill line, wherein said drilling pipe (14) and said riser pipe (3) communicate with a lower pipe ram (5) which is adapted to carry the weight of a drill string (14) and at the same time provide a sealing between the subsea blow-out preventer (1) and the drilling pipe (14), as well as a shear ram (7) which is adapted to shear off the drill string (14), and that above the subsea blow-out preventer (1) there is provided an emergency quick disconnect connector (9) which releases the riser pipe (3) and further wherein the subsea blow-out preventer (1) comprises (a) an upper pipe ram (8) which is located above said shear ram (7), said upper pipe ram (8) being adapted to close the drilling pipe (14) when this has been passed down into the subsea blow-out preventer (1) for thereby letting the drill string (14) make a tight connection between the upper pipe ram (8) and the surface, and (b) side valves which communicate with a point below the lower pipe ram (5) in order to conduct the pressure below said pipe ram (5) to the riser pipe (3) above the upper pipe ram (8) having been adapted to hold a newly established drill string (14).

2. The device as claimed in claim 1, characterized in that for a drilling mud which is pumped down to a newly established drill string (14) there is established a circulation path through the upper pipe ram (8), through the lower shear ram (7) and internally down into the drill string (14) hanging in the lower pipe ram (5), and that there is established a return communication coming from the well (4) on the exterior side of the drill string (14) towards the lower pipe ram (5) which is closed, and is conducted through the side valves (15, 16) and further into the riser pipe (3) above said upper pipe ram (8), and upwardly through the riser pipe (3) towards the surface blow-out preventer (2).

3. The device as claimed in claim 2, characterized in that the surface blow-out preventer (2) comprises a pipe ram (17) and branch conduits which communicate with a choke manifold (18).

4. The device as claimed in claim 2, characterized in that the device comprises a hydraulic control unit and a test unit (10A) which through one or more valves (10–13) controls the pressure conditions in the subsea blow-out preventer (1).

5. The device as claimed in claim 4, characterized in that the test unit (10A) communicates with a first branch conduit by means of a first set of valves (12, 13) sensing the pressure below said shear ram (7) of the subsea blow-out preventer (1), as well as a second branch conduit comprising a second set of valves (10, 11) sensing the pressure below the lower pipe ram (5).

6. A method of use of a drill pipe (14) and a high pressure riser pipe (3) between a surface blow-out preventer (2) and a subsea blow-out preventer (1) as two separate circulation lines as a substitute for choke line and kill line to reestablish communication with a well comprising pumping drilling mud of correct specific gravity down through the drill pipe (14) through an upper pipe ram (8) and a lower pipe ram (5) in the subsea blow-out preventer (1) wherein the drilling mud rises in the well at the exterior of the drill pipe (14) toward the lower pipe ram (5) in a closed configuration and is directed through one or more side valves in the subsea blow-out preventer (1) into the riser pipe (3) above the upper pipe ram (8) to the surface blow-out preventer (2).

7. The method as claimed in claim 6, wherein the drill pipe (14) is hanging in the subsea blow-out preventer (1) and extending to the surface as a first communication path and communication between the well (4) and the surface blow-out preventer (2) is achieved through an annulus of the riser pipe (3) and an annulus of the well (4), for stabilizing circulation between the thus established communication paths.

* * * * *